US010894679B2

(12) United States Patent
Brown et al.

(10) Patent No.: US 10,894,679 B2
(45) **Date of Patent: *Jan. 19, 2021**

(54) ANTI-ROTATION DEVICE AND METHOD OF USE

(71) Applicant: United States Postal Service, Washington, DC (US)

(72) Inventors: John W. Brown, Manassas, VA (US); Edward F. Houston, Bristow, VA (US); Juan A. Roman, Fairfax, VA (US); Leung M. Shiu, Gaithersburg, MD (US); Riley H. Mayhall, Germantown, MD (US); Jacob L. Timm, Pasadena, CA (US); Reza Badri, Towson, MD (US); Thomas A. Hillerich, Louisville, KY (US)

(73) Assignee: United States Postal Service, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/573,887

(22) Filed: Sep. 17, 2019

(65) Prior Publication Data

US 2020/0010294 A1 Jan. 9, 2020

Related U.S. Application Data

(63) Continuation of application No. 15/668,238, filed on Aug. 3, 2017, now Pat. No. 10,421,630.

(51) Int. Cl.
*B65H 3/12* (2006.01)
*B65H 1/02* (2006.01)

(52) U.S. Cl.
CPC ..... *B65H 3/124* (2013.01); *B65H 1/025* (2013.01); *B65H 2402/545* (2013.01); *B65H 2404/1521* (2013.01); *B65H 2404/1532* (2013.01)

(58) Field of Classification Search
CPC .... B65H 3/56; B65H 3/60; B65H 2404/1521; B65H 2404/1532; B65H 2220/01;
(Continued)

(56) References Cited

U.S. PATENT DOCUMENTS 2,485,952 A 10/1949 Apgar et al.
3,126,201 A 3/1964 Rehm
(Continued)

FOREIGN PATENT DOCUMENTS

DE 196 12 567 A1 10/1997
DE 103 50 623 B3 4/2005
(Continued)

OTHER PUBLICATIONS

Written Opinion of the International Preliminary Examining Authority dated Jul. 7, 2015 for International Patent Application No. PCT/US14/23300.
(Continued)

*Primary Examiner* — Gregory W Adams
(74) *Attorney, Agent, or Firm* — Knobbe Martens Olson & Bear LLP

(57) ABSTRACT

A device for reducing rotation of an article during singulation of a stack of articles is disclosed. The device may include a torsion element, a rotatable member configured to rotate about an elongated axis of the torsion element between a first position and a second position, and a revolving member coupled to the rotatable member. An outer surface of the revolving member contacts a drive belt in the first position and an article in the second position. The torsion element exerts torque on the rotatable member when it moves from the first position towards the second position. The torque causes the outer surface of the revolving member
(Continued)

to apply a frictional force to the article, thereby minimizing rotation of the article. Systems and methods of singulating articles are also disclosed.

16 Claims, 9 Drawing Sheets

(58) Field of Classification Search
CPC ..... B65H 2511/11; B65H 2513/53; B65H 2701/1916; B65H 2220/02; B65H 2220/03; B65H 2301/321; B65H 2511/20; B65H 5/025
USPC ..... 198/836.2; 271/10.08, 12, 121, 149, 271/3.18, 3.21, 4.07
See application file for complete search history.

(56) References Cited

U.S. PATENT DOCUMENTS 3,485,488 A 12/1969 Ellison
3,649,002 A 3/1972 Burkhardt
3,817,516 A 6/1974 Lazzarotti et al.
3,854,613 A 12/1974 Renfrow
3,902,587 A 9/1975 Checcucci
3,988,017 A 10/1976 Kyhl
4,030,723 A 6/1977 Irvine et al.
4,163,550 A * 8/1979 Armstrong ..... B65H 29/20 198/836.2
4,257,587 A 3/1981 Smith
4,567,492 A * 1/1986 Skafvenstedt ..... G01D 15/24 226/17
4,579,501 A 4/1986 Fox
4,595,188 A 6/1986 Wiley et al.
4,653,741 A 3/1987 Palmer
4,696,392 A 9/1987 Chisholm, Jr.
4,819,927 A 4/1989 Noguchi et al.
4,893,804 A * 1/1990 Sasage ..... B65H 3/124 271/11
4,908,673 A 3/1990 Muramatsu
5,033,729 A 7/1991 Struthers
5,044,877 A 9/1991 Constant et al.
5,064,341 A 11/1991 Pippin
5,165,675 A 11/1992 Kanaya
5,246,223 A 9/1993 Ricciardi et al.
5,265,868 A 11/1993 Bowser et al.
5,271,710 A 12/1993 Decharran et al.
5,358,229 A 10/1994 Groel et al.
5,379,992 A 1/1995 Holmes et al.
5,391,051 A 2/1995 Sabatier et al.
5,407,317 A * 4/1995 Pippin ..... B65G 1/1376 186/52
5,409,204 A 4/1995 Strohmeyer et al.
5,464,316 A 11/1995 Kranz
5,507,480 A 4/1996 Martin et al.
5,520,380 A * 5/1996 Martin ..... B07C 1/025 271/104
5,626,338 A 5/1997 Fattebert
5,630,697 A 5/1997 Black, Jr.
5,645,275 A 7/1997 Tranquilla
5,752,695 A 5/1998 Jehan et al.
5,755,437 A 5/1998 Ek
5,829,742 A 11/1998 Rabindran et al.
5,893,701 A 4/1999 Pruett
5,906,468 A 5/1999 Vander Syde et al.
5,908,191 A 6/1999 Chen et al.
5,934,866 A 8/1999 Redden
5,947,468 A 9/1999 McKee et al.
5,954,330 A 9/1999 Rabindran et al.
5,957,448 A 9/1999 Frank et al.
5,992,610 A 11/1999 Dufour et al.
6,003,857 A 12/1999 Salomon et al.
6,085,182 A 7/2000 Cordery
6,186,491 B1 2/2001 Tomiyama et al.
6,217,020 B1 4/2001 Supron et al.
6,270,070 B1 8/2001 Salomon et al.
6,276,586 B1 8/2001 Yeo et al.
6,302,638 B1 10/2001 Eggebrecht
6,378,692 B1 4/2002 Cera et al.
6,402,134 B1 6/2002 Gauger et al.
6,494,446 B1 12/2002 Tomiyama et al.
6,503,044 B1 1/2003 Enekel
6,511,062 B1 1/2003 Blackwell et al.
6,679,491 B2 * 1/2004 Luebben ..... B07C 1/02 271/150
6,702,275 B2 3/2004 Niiyama et al.
6,715,755 B2 4/2004 Sussmeier
6,726,200 B2 4/2004 Gohl et al.
6,729,617 B1 5/2004 Chaume et al.
6,739,449 B2 5/2004 Mang et al.
6,820,873 B2 11/2004 Kulpa
7,025,347 B2 4/2006 Masui et al.
7,195,236 B2 3/2007 Hillerich et al.
7,431,292 B2 * 10/2008 Goto ..... B65H 5/062 271/272
7,467,792 B2 12/2008 Bittenbender et al.
7,537,207 B2 5/2009 Kutzer et al.
7,537,212 B2 5/2009 Mitsuya et al.
7,552,918 B2 6/2009 Blackwell et al.
7,628,393 B2 12/2009 Mitsuya et al.
7,686,299 B2 * 3/2010 Herrmann ..... B65H 9/12 271/228
7,703,769 B2 4/2010 Schwarzbauer
7,712,735 B2 5/2010 Chorier-Pichon et al.
7,722,039 B2 5/2010 Shoji et al.
7,806,400 B2 10/2010 Fukusaka
7,832,721 B2 11/2010 Kutzer et al.
8,091,885 B2 1/2012 Conaway et al.
8,459,634 B2 6/2013 Asari et al.
8,960,661 B2 2/2015 Hugues
9,044,783 B2 6/2015 Brown et al.
9,056,738 B2 * 6/2015 Brown ..... B65H 3/124
9,061,849 B2 6/2015 Brown et al.
9,340,377 B2 5/2016 Brown et al.
9,834,395 B2 * 12/2017 Brown ..... B65H 3/66
9,943,883 B2 4/2018 Brown et al.
10,131,513 B2 11/2018 Brown et al.
10,421,630 B2 * 9/2019 Brown ..... B65H 7/16
2002/0011703 A1 1/2002 Tomiyama et al.
2002/0153654 A1 10/2002 Blackwell et al.
2003/0141652 A1 7/2003 Guddanti et al.
2004/0193554 A1 9/2004 Hillerich, Jr. et al.
2005/0077217 A1 4/2005 Hillerich, Jr. et al.
2006/0053754 A1 3/2006 Carrigan et al.
2006/0087068 A1 4/2006 Bittenbender et al.
2007/0085259 A1 4/2007 Grogor et al.
2007/0252321 A1 11/2007 Kutzer et al.
2007/0296140 A1 12/2007 Babanats et al.
2008/0012202 A1 1/2008 Hubl et al.
2009/0028678 A1 1/2009 Kutzer
2009/0189332 A1 7/2009 Schwarzbauer et al.
2009/0206014 A1 8/2009 Enenkel
2009/0283963 A1 11/2009 Fee et al.
2010/0032889 A1 2/2010 Krause et al.
2010/0038840 A1 2/2010 Watanabe et al.
2010/0258407 A1 10/2010 Krause et al.
2010/0289205 A1 11/2010 Taki
2010/0329833 A1 12/2010 Ambroise et al.
2011/0116904 A1 5/2011 Stone et al.
2011/0129324 A1 6/2011 Philippe et al.
2011/0278785 A1 11/2011 Franzone et al.
2012/0013064 A1 1/2012 Samain et al.
2012/0013065 A1 1/2012 Ambroise et al.
2012/0153563 A1 6/2012 Schulze-Hagenest et al.
2012/0154795 A1 6/2012 Kobayashi
2012/0292845 A1 11/2012 De Ambrogio et al.
2012/0299236 A1 11/2012 Fujita et al.
2012/0319347 A1 12/2012 Moore
2014/0271087 A1 9/2014 Brown et al.
2014/0271088 A1 9/2014 Houston et al.
2014/0271090 A1 9/2014 Brown et al.
2014/0271091 A1 9/2014 Brown et al.
2014/0271098 A1 9/2014 Brown et al.

(56) References Cited

U.S. PATENT DOCUMENTS

FOREIGN PATENT DOCUMENTS

| | | | |
|---|---|---|---|
| EP | 0 926 085 | A1 | 6/1999 |
| EP | 1 531 137 | A1 | 5/2005 |
| EP | 2 386 507 | A1 | 11/2011 |
| JP | S 57-166244 | | 10/1982 |
| JP | 60-56738 | | 4/1985 |
| JP | H01-110446 | | 4/1989 |
| JP | 01-288538 | | 11/1989 |
| JP | H07-53079 | | 2/1995 |
| JP | 2000-85999 | | 3/2000 |
| JP | 2001-300432 | | 10/2001 |
| JP | 2002-068490 | | 3/2002 |
| JP | 2003-136796 | | 5/2003 |
| JP | 2003-171028 | | 6/2003 |
| JP | 2007-503981 | | 3/2007 |
| JP | 2011-104587 | | 6/2011 |

OTHER PUBLICATIONS

International Search Report and Written Opinion dated Sep. 9, 2014 for International Application No. PCT/US14/23300.

* cited by examiner

ANTI-ROTATION DEVICE AND METHOD OF USE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation of U.S. application Ser. No. 15/668,238, filed Aug. 3, 2017, which is a continuation of U.S. application Ser. No. 14/719,142, filed May 21, 2015, now U.S. Pat. No. 9,834,395, which is a continuation application of U.S. application Ser. No. 13/801,749, filed Mar. 13, 2013, now U.S. Pat. No. 9,056,738, the entire contents of which is hereby incorporated in its entirety.

BACKGROUND

Technical Field

The disclosure relates to the field of automatic separation of items. More specifically, the present disclosure relates to the automatic singulation of articles from a bulk stack of articles.

Description of the Related Art

Articles, such as items of mail, are frequently provided in bulk and must be separated in order to properly sort and route each article. The process of separating a bulk stack of articles into individual articles, known as singulation, can be done automatically by placing the bulk stack of articles into a feeder. Current feeders include one or more conveyor belts for moving the articles, as well as a vacuum for applying suction to one side of an article piece positioned at the front of the bulk stack. This suction works to separate the lead article from the remainder of the bulk stack. The lead article can then be moved by a conveyor belt in a direction different from the direction of the bulk stack. Such a design frequently causes problems when used to sort some articles, such as magazines, catalogs, and other similar items having a plurality of unbound edges. The vacuum often applies suction to only a front portion of such articles, thereby inducing only the front portion to move in a different direction than the remainder of the bulk stack. In such situations, at least some of the internal pages and the back cover resist the directional change in motion, possibly resulting in folding, tearing, and/or other damage to the article.

SUMMARY

The present disclosure describes devices and methods used to reduce rotation of an article during singulation of a bulk stack of articles. In some embodiments, the devices and methods disclosed herein are intended to apply a frictional force to a back surface of an article, while suction and an accelerating force are applied to a front surface of the article. In some such embodiments, the frictional force is intended to hold the article together, to resist tearing, and cause the article to move as a single, unitary article. Some embodiments disclosed herein reduce the amount of folding, tearing, or other damage experienced by articles during the article separation and sorting process.

The embodiments disclosed herein each have several innovative aspects, no single one of which is solely responsible for the desirable attributes of the invention. Without limiting the scope, as expressed by the claims that follow, the more prominent features will be briefly disclosed here. After considering this discussion, one will understand how the features of the various embodiments provide several advantages over current singulation methods and devices.

One aspect of the disclosure relates to a device for reducing rotation of an article during singulation of a stack of articles. In some embodiments, the device includes a torsion element connected directly or indirectly to a base, a rotatable member coupled to the torsion element and rotatable about an inner axis of the torsion element between at least a first position and a second position, and a revolving member coupled to the rotatable member and configured to revolve about a central axis extending angularly relative to an elongated axis of the rotatable member. In the first position of the rotatable member, an outer surface of the revolving member is in contact with a drive belt. In the second position of the rotatable member, the torsion element applies a torque to the rotatable member and the revolving member, and the outer surface of the revolving member is in contact with, and applies a force to, a back face of an article, the article having a front face in contact with the drive belt.

In some embodiments, the torsion element is a torsion bar connected to the base. In other embodiments, the torsion element is a helical torsion spring disposed within or around a structural support member, and the structural support member is connected to the base.

In various embodiments, the rotatable member is configured to transition from the first position toward the second position when the drive belt brings the article in contact with the revolving member. The rotatable member of some embodiments is a lever arm.

In some embodiments, the central axis, which the revolving member is configured to spin about, extends perpendicularly relative to the elongated axis of the rotatable member.

In some embodiments, the force applied by the revolving member to the back face of the article includes a frictional force.

The revolving member of some embodiments includes a plurality of wheels. In some embodiments, the device also includes a shaft positioned along the central axis. The shaft is coupled to the rotatable member, and the revolving member is disposed about, and configured to spin relative to, the shaft. In other embodiments, the revolving member includes a shaft portion and an extended wheel portion fixed to the shaft portion. The shaft portion and the extended wheel portion are configured to spin about the central axis, and the shaft portion is coupled to the rotatable member.

An additional aspect of the disclosure relates to a system for singulating a stack of articles while reducing damage to each article. The system of various embodiments includes a conveyor belt configured to move a stack of articles forward, a drive belt configured to laterally accelerate an article in the stack of articles, and an anti-rotation device configured to provide a frictional force to a back face of the article to resist upward motion of the back face during lateral acceleration of the article. The anti-rotation device includes a torsion element connected directly or indirectly to a base, a rotatable member coupled to the torsion element and rotatable about an inner axis of the torsion element between at least a first position and a second position, and a revolving member coupled to the rotatable member and configured to revolve about a central axis extending angularly relative to an elongated axis of the rotatable member. In the first position of the rotatable member, an outer surface of the revolving member is in contact with the drive belt. In the second position of the rotatable member, the torsion element applies a torque to the rotatable member and the revolving member. Also in the second position, the outer surface of the revolving member is in contact with the back face of the article, the front face of the article being in contact with the drive belt.

In some such embodiments, the drive belt and the conveyor belt are positioned on different, non-parallel planes. The drive belt of some embodiments is perforated. In some embodiments, the system also includes an air-moving component configured to apply a suction force to the front face of the article in order to couple lateral movement of the drive belt with lateral movement of the article.

A further aspect of the disclosure relates to another system for singulating a stack of articles while reducing damage to each article. The system includes means for moving a stack of articles forward, means for separating and laterally accelerating a forward-most article from the stack of articles, and means for applying friction to a back face of the article to resist upward motion of the back face during lateral acceleration of the article.

In some embodiments, the means for moving the stack of articles forward includes a first conveyor belt. In some embodiments, the means for separating the article from the stack of articles includes an air-moving apparatus and a second conveyor belt having an air hole. The air-moving apparatus of some such embodiments includes a vacuum; in other embodiments, the air-moving apparatus includes a forward-blowing fan. In some embodiments, the means for applying friction comprises a revolving member indirectly coupled to a torsion element.

In another aspect of the disclosure, a method of singulating a stack of articles is provided, which reduces damage to the articles in the stack. In various embodiments, the method includes moving a stack of articles forward, separating and laterally accelerating a forward-most article from the stack of articles, and applying a force to the forward-most article in order to resist upward motion of the back face during lateral acceleration of the forward-most article. The force is applied to the back face by a revolving member indirectly coupled to a torsion element.

In some embodiments of the method, the force comprises a frictional force. The frictional force of some such embodiments is applied by the revolving member when a lever arm coupled to the revolving member rotates about an elongated inner axis of the torsion element from a first position to a second position and the torsion element exerts a torque on the lever arm. In some such embodiments, the torsion element is a torsion bar or a helical torsion spring.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting.

DETAILED DESCRIPTION OF CERTAIN EMBODIMENTS

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure.

To assist in the description of the devices and methods described herein, some relational and directional terms are used. "Connected" and "coupled," and variations thereof, as used herein include direct connections, such as being contiguously formed with or attached directly to, on, within, etc. another element, as well as indirect connections where one or more elements are disposed between the connected elements. "Connected" and "coupled" may refer to a permanent or non-permanent (i.e., removable) connection.

"Secured" and variations thereof as used herein include methods by which an element is directly fastened to another element, such as being glued, screwed or otherwise affixed directly to, on, within, etc. another element, as well as indirect means of attaching two elements together where one or more elements are disposed between the secured elements.

The devices, systems, and methods described herein provide for improved separation or singulation of articles provided in bulk stacks. For example, in various embodiments, the disclosed devices, systems, and methods provide for improved separation of articles, such as articles of mail. Various embodiments reduce rotation of an article during singulation by applying a frictional force to a back surface, such as the back cover of the article. This frictional force is often applied while suction and an accelerating force are applied to a front surface, such as the front cover of the article. The frictional force is intended to hold the article of mail together to reduce the amount of folding, tearing, or other damage experienced by the article during singulation. While various embodiments included herein are described in relation to stack feeders and the process of singulating articles of mail, this example is provided for ease of discussion, and the disclosure is not limited thereto. One of skill in the art will appreciate that various embodiments disclosed herein are applicable to a variety of manufacturing and assembly applications involving the separation of individual articles from a bulk stack of goods, and all such applications are hereby expressly contemplated and incorporated herein.

Figure 1:
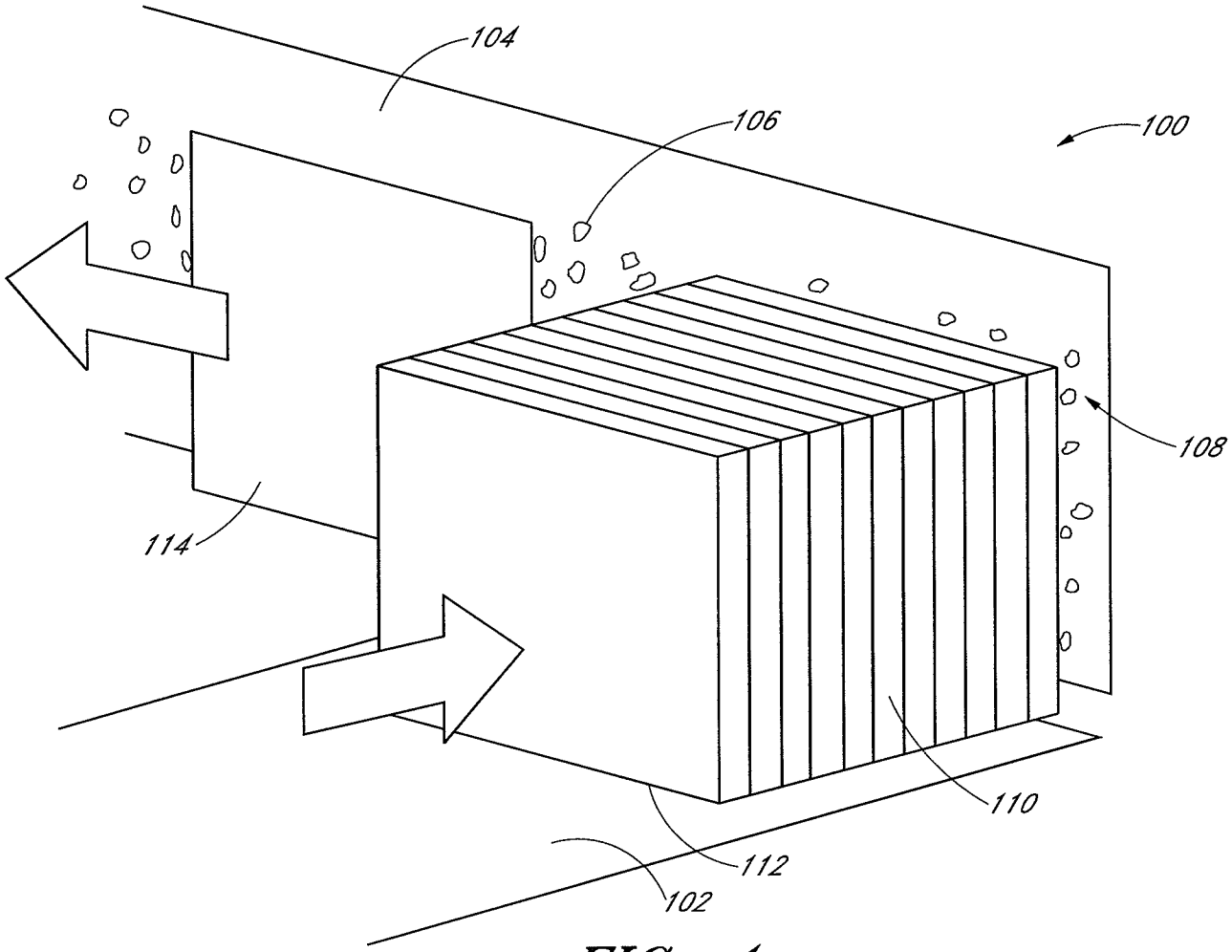
FIG. 1 is a schematic illustration of a bulk stack of articles being singulated.

Bulk stacks of articles are often sorted via a singulator. For example, as shown in the partial view of an article feeder 100 in FIG. 1, a horizontal conveyor belt 102 is configured to move a horizontal bulk stack of mail 110 toward a vertical conveyor belt 104, and the vertical conveyor belt 104 is configured to move the articles laterally as compared to the horizontal conveyor belt 102. A horizontal bulk stack of articles 110 may be a stack wherein one of the long edges of each article, such as the long, bound edge of the articles, are all oriented in the same direction, and the bound edges 112 are aligned along the relatively horizontal plane of the horizontal conveyor belt 102. Each article within the bulk stack 110 is positioned parallel to the other articles, and the front and back faces of each article are relatively perpendicular to the horizontal plane of the horizontal conveyor belt 102, often with a 0 to 10 degree lean relative to the perpendicular position. The mail articles within the stack touch and support each other.

The horizontal conveyor belt 102 and the vertical conveyor belt 104 are positioned in perpendicular planes. As the bulk stack of mail 110 is carried along by the horizontal conveyor belt 102 toward the vertical conveyor belt 104, a front surface of a lead article 114 approaches the vertical conveyor belt 104. The vertical conveyor belt 104 is perforated with air holes 106. An air-moving component (not shown) is positioned in front of the vertical conveyor belt 104 to form a vacuum-backed vertical conveyor belt assembly. The inclusion of the air-moving component causes air to move from the rear, mail carrying side 108 of the vertical conveyor belt 104 through the air holes 106, thereby creating a suction force on the rear side 108 of the vertical conveyor belt 104. The air-moving component may be a forward-blowing fan, a pump, a vacuum, or any other partial-vacuum-inducing component known to one of skill in the art. The suction created by the air-moving component works to separate the lead article 114 from the remainder of the bulk stack 110. The suction causes at least the front surface of the lead mail article 114 to couple to the vertical conveyor belt 104, inducing the front-most mail article 114 to move laterally with the vertical conveyor belt 104. More detail regarding the operation of an automatic feeder for a stack of articles can be found in U.S. patent application Ser. No. 13/797,291, filed on Mar. 12, 2013, the contents of which are herein incorporated by reference in their entirety.

Figure 2:
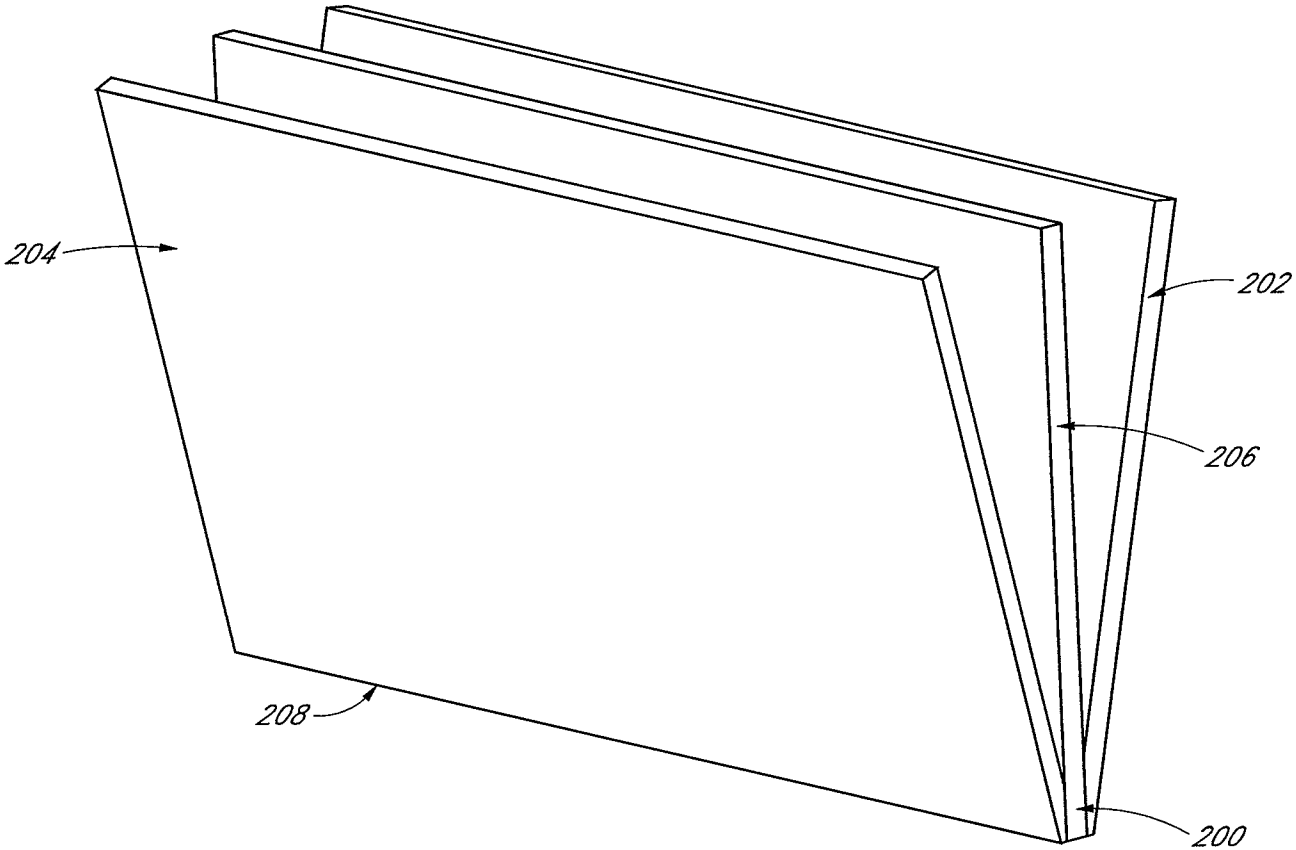
FIG. 2 is a schematic illustration of an open article.

FIG. 2 depicts an open article 200. An open article, such an article of open mail, is defined as an article that is only bound on one of four edges and is not enclosed in a container such as an envelope, plastic bag, or outer sleeve. Open mail often includes magazines and catalogs, which have a front cover 202, a back cover 204, and one or more internal pages 206 bound together along a horizontal binding 208. Because the open mail article 200 does not have a unitary body, but rather has multiple pages capable of moving independently along three edges, open articles, such as open mail pieces, are particularly susceptible to damage.

Figure 3:
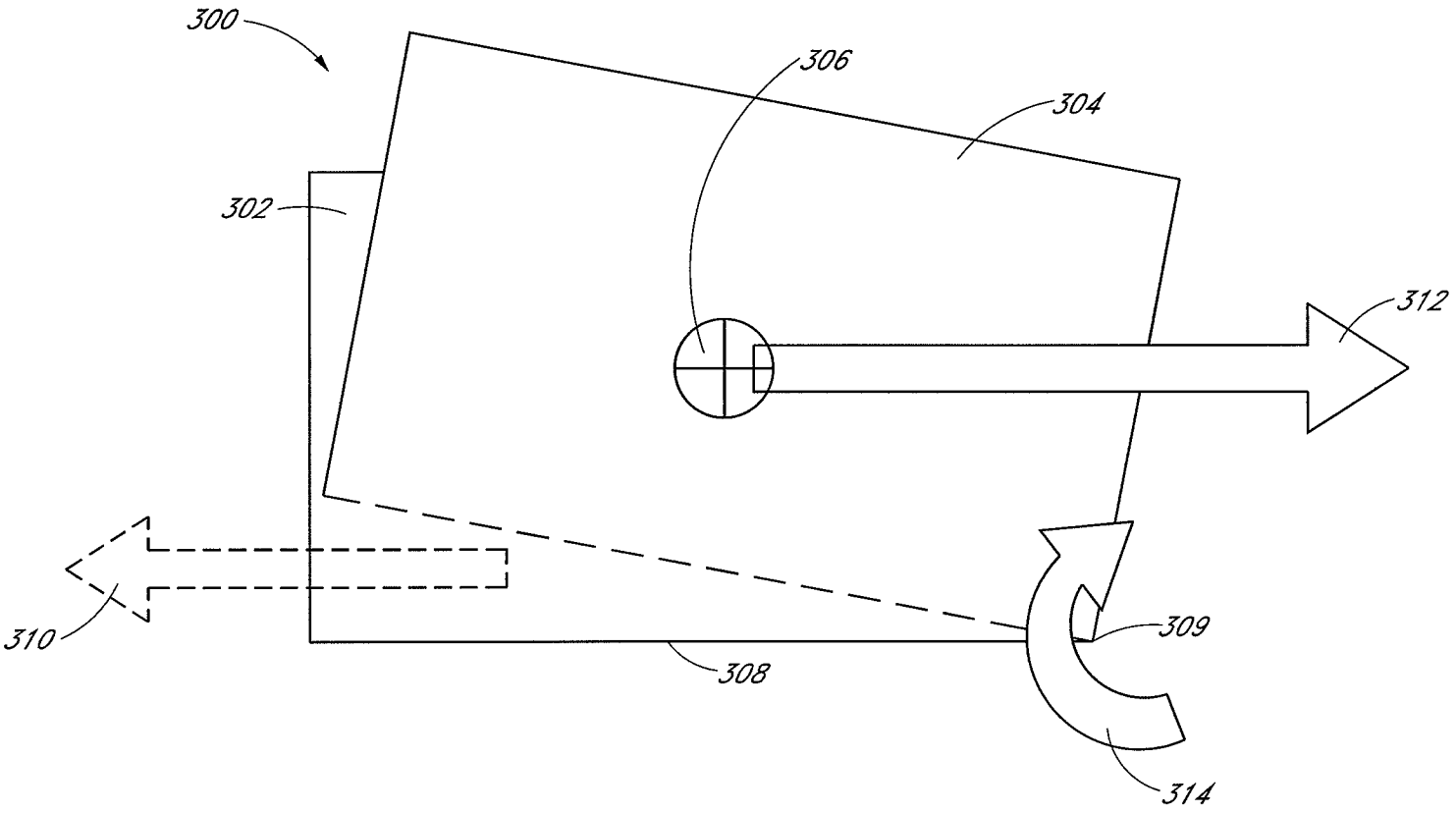
FIG. 3 is a schematic diagram illustrating the forces applied to an open article during singulation via a prior art mail feeder.

As shown in FIG. 3, when an open article 300 transitions from moving forward with along the horizontal conveyor belt 102 to accelerating laterally due to the vertical conveyor belt 104, a variety of forces are exerted on various portions of the open mail article 300. During singulation, the suction strength of the vacuum is regulated and maintained at a relatively low value to avoid picking up more than one article of mail at a time. The vacuum created by the air-moving component may only be forceful enough to provide suction to a front surface (not shown) of the open article 300. In such situations, only the front cover 302 (and at times, one or more of the internal pages) is picked up by the suction force and is accelerated laterally with the perforated, vacuum-backed, vertical conveyor belt 104. The back cover 304 resists the directional change in motion. That is, when the acceleration force 310 is applied to the front cover 302 of the open article 300 by the vacuum-backed lateral-moving conveyor belt, an inertial force 312 acts through the center of gravity 306 of the back cover in the opposite direction. The interplay of these competing forces imparts shearing forces and torque 314 on the binding 308 of the open article 300. These forces may causes a portion of the article 300 to pivot about an upstream corner 309. As a consequence, often, a downstream portion 305 of the back cover 304 twists upward. This twisting can lead to tearing, folding, and other damage to the open article 300.

In order to reduce damage to mail articles, some embodiments disclosed herein aim to hold each open article closed such that friction is generated between the front cover, back cover, and internal pages of each article. The internal friction then works to resist inertial forces and reduce shearing forces generated on the cover and binding. Additionally or alternatively, some embodiments disclosed herein aim to provide a downward reaction force on the back cover of each mail article as the article is accelerated laterally, thereby distributing the torque that is generated by the inertial forces over both the front and back cover. Some embodiments disclosed herein may achieve one or more of the above-recited aims, at least in part, utilizing spring-loaded high friction wheels having low friction bearings. More generally, various embodiments described herein may achieve one or more of the above-recited aims through the inclusion of an anti-rotation device.

Figure 4:
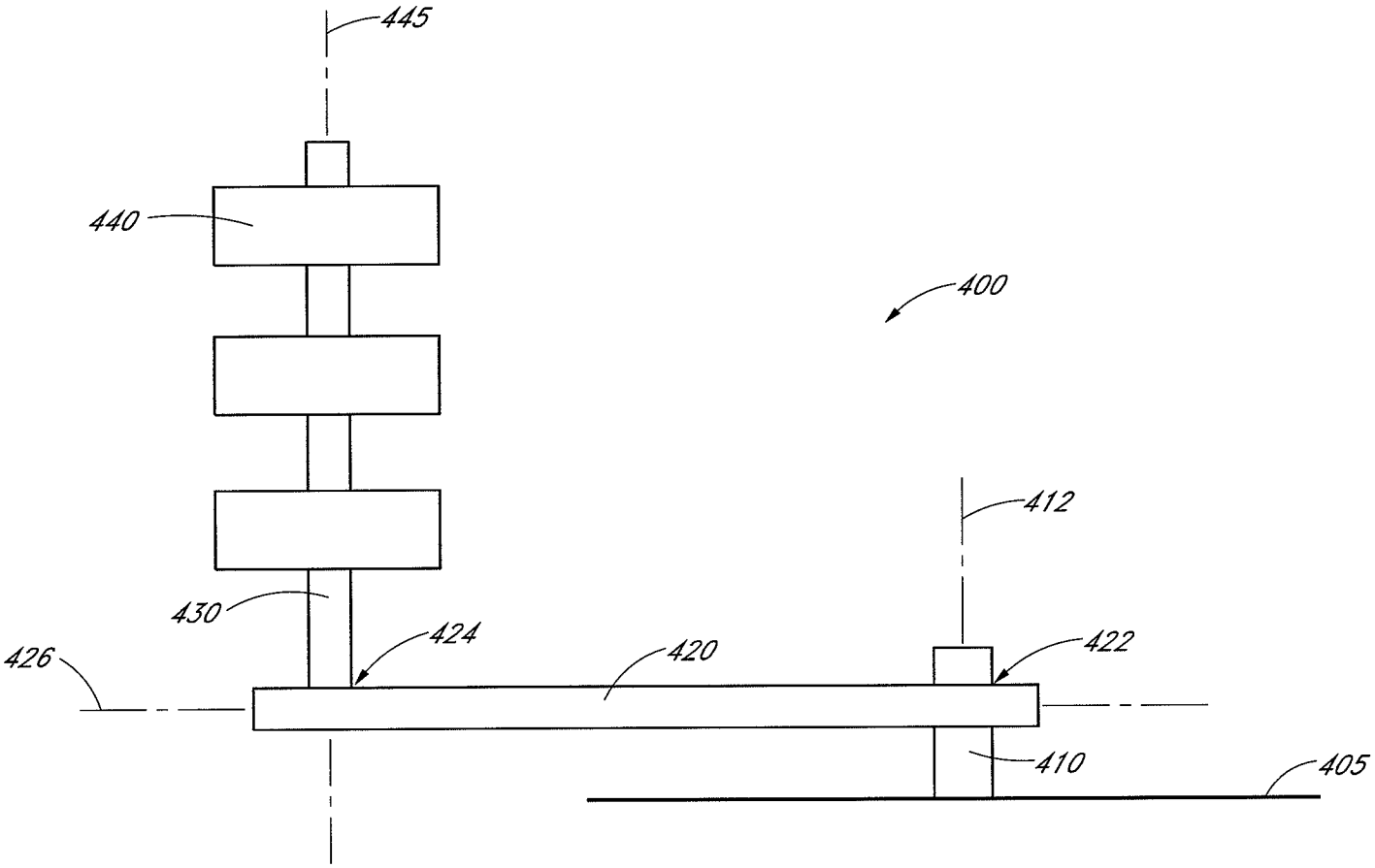
FIG. 4 is a side elevation view of one embodiment of an anti-rotation device.

FIG. 4 provides a side plan view of one embodiment of an anti-rotation device 400 for inclusion in an article feeder. In some embodiments, the anti-rotation device 400 includes a torsion element, such as, for example, a torsion bar 410. The torsion bar 410 is connected to a base 405. The base 405 may be any supportive, component or surface of the stack feeder. In some embodiments, the torsion bar 410 is a generally straight rod pivotably connected to the base 405 such that the torsion bar 410 pivots about an axis of rotation 412 running through the center of the torsion bar 410. In some embodiments, the torsion bar 410 is made of an elastic material which allows for rotational flexibility or elasticity of the torsion bar 410. The pivotable connection between the torsion bar 410 and the base 405 allows a pivot between at least a first relaxed position and a second, twisted position in which a torque is applied to at least portion of the torsion bar 410. In the second, twisted position, potential energy is stored in the torsion bar 410, motivating the torsion bar 410 to return to the first configuration. In some embodiments, as will be described below in greater detail, the torsion bar comprises a rotation resistance member, or is otherwise configured to resist rotational movement.

The anti-rotation device of some embodiments comprises a rotatable member, such as, for example, a lever arm 420. In the depicted embodiment, the lever arm 420 has a threaded through hole 422 on a proximal portion of the lever arm 420. The threads of the through hole are configured to be disposed around, and securely engage, complementary threads (not visible) disposed on at least a portion of an outer surface of the torsion bar 410. In some embodiments, any other suitable engagement mechanism known to one of skill in the art may be utilized to secure the lever arm 420 to the torsion bar 410. For example, in some embodiments, a snap fit, a rivet, a screw, a friction fit, or permanent melding or welding, or any other desired engagement mechanism may be used. In some embodiments, the torsion bar 410 and the lever arm 420 may be distinct portions of the same unitary object and are integrally formed, as a non-limiting example, by means of injection molding. As the lever arm 420 is attached to the torsion bar 410, the lever arm 420 is rotatable about the axis of rotation 412 of the torsion bar 410 between at least a first position and a second position. The anti-rotation device 400 of FIG. 4 is shown in the first, non-rotated position. In some embodiments, the extent of rotation between the first position and the second position is only a couple degrees or less. In other embodiments, the extent of rotation between the first position and the second position may be 5 degrees, 15 degrees, or any value therebetween. In some embodiments, the range of rotation between the first position and the second position may be greater than 15 degrees. In some embodiments, the lever arm 420 rotates about the axis of rotation 412 of the torsion bar 410 within a plane of rotation that is substantially parallel with the base 405.

Some embodiments of the anti-rotation device comprise a revolving member coupled to a distal portion of the lever arm 420. For example, the anti-rotation device 400 comprises a plurality of wheels 440 coupled to the distal portion of the lever arm 420. In some embodiments, the plurality of wheels 440 is coupled to the distal portion of the lever arm 420 by means of a wheel shaft 430. The wheels 440 are disposed around the wheel shaft 430 and rotate relative to the wheel shaft 430 via low friction bearings which are disposed at intervals on the wheel shaft 430.

The wheel shaft 430 is coupled to a distal portion of the lever arm 420 via threads (not visible) positioned on a bottom end of the wheel shaft's outer surface. The threads are configured to securely engage complementary threads disposed around a through hole 424 in a distal portion of the lever arm 420. In other embodiments, any other suitable engagement mechanism known to one of skill in the art may be utilized to secure the wheel shaft 430 to the lever arm 420. For example, in some embodiments, a snap fit a rivet, a screw, a friction fit, or permanent melding or welding, or any other desired engagement mechanism may be used. In some embodiments, the wheel shaft 430 and the lever arm 420 may be distinct portions of the same unitary object.

In some embodiments, the wheels 440 are non-movably fixed to the wheel shaft 430 and the wheel shaft 430 is coupled to the lever arm 420 via a low friction bearing. In such embodiments, the wheel shaft 430 is configured to rotate relative to the lever arm 420, which in turn, rotates the wheels 440. In some embodiments, a rotating cylinder or other revolving member may couple to the lever arm 420 via a wheel bracket or via a shaft portion extending from one end of the revolving member. In various embodiments, the revolving member spins about an axis extending angularly relative to an elongated axis of the rotatable member.

In some embodiments, each of the plurality of wheels 440 has an equal diameter and shares an axis of rotation 445. The wheels 440 spin about the wheel shaft 430 around axis of rotation 445, which is positioned perpendicularly to an elongated axis 426 of the lever arm 420.

Figure 5:
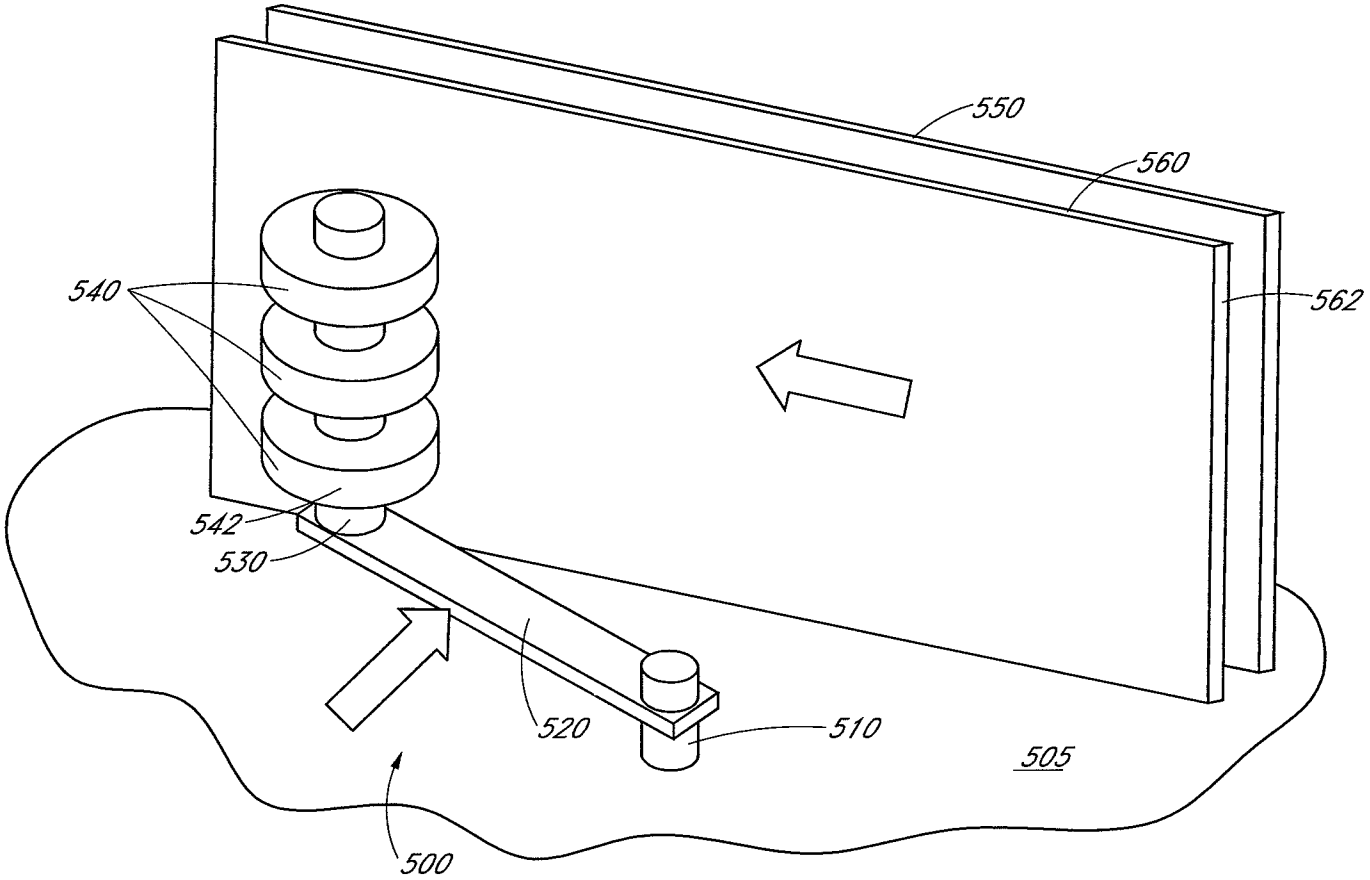
FIG. 5 is a perspective view of one embodiment of an anti-rotation device.

FIG. 5 provides a perspective view of an embodiment of an anti-rotation device 500, shown in the first position. The anti-rotation device 500 may be similar to the anti-rotation devices described with regard to FIG. 4. As described above, the anti-rotation device 500 may be configured to rotate between at least a first position and a second position. In the first position, the torsion bar 510 is in an initial state. The torsion bar 510 is pivotably connected to a base 505, and the pivotable connection is disposed near the drive belt 550. The lever arm 520 extends from the torsion bar 510 at an angle which places an outer surface 542 of the wheels 540 in contact with a drive belt 550. The wheels 540 are rotatably connected to the wheel shaft 530. The proximity of the pivotable connection between the torsion bar 510 and the base 505 allows the wheels 540 to rest in contact with the drive belt 550 without creating significant losses of energy of the drive belt 550 due to friction.

The outer surface 542 of the wheels 540 are configured to rotate. Thus, when the drive belt 550 moves, the friction between the outer surface 542 of the wheels 540 and the drive belt 550 causes the wheels 540 to rotate around wheel shaft 530. As described above, the drive belt 550 may be used to singulate an article using a vacuum force exerted through one or more openings in the drive belt 550.

As described above, the drive belt 550 is configured to move an article 560, for example, an open article such as a magazine, catalog, or any other article, laterally into the stack feeder as part of the process of singulation. As the drive belt 550 moves the article 560, the article 560 contacts a portion of the outer surface 542 of the wheels 540, the article 560 applies a force to the lever arm 520, which causes the torsion bar 510 to rotate. The rotation of the torsion bar 510 allows the wheels 540 to move away from the belt 550, and to roll onto an outer, back cover of the article 560. The lever arm 520 is pushed by the laterally moving mail article 560 into the second position, thereby making room for the article 560 to pass between the drive belt 550 and the outer surface 542 of the wheels 540. The push from the moving mail article 560 causes the lever arm 520 to angularly rotate within its plane of rotation, which is parallel to the base 505 and the floor. This rotation of the lever arm 520 applies torque to a portion of the torsion bar 510, causing the torsion bar 510 to twist or rotate about an axis. As will be described below, the torsion bar 510 is configured to resist such motion, and the twisting generates tension or potential energy in the torsion bar 510. The tension causes the torsion bar 510 to apply a counter-torque to the lever arm 520, thereby resisting the rotation, and biasing the lever arm 520 back towards the first position. The rotation, tension, counter-torque and resulting forces generated by the twisting torsion bar 510 cause the wheels 540 to apply a force onto the article 560, which effectively pushes the article 560 into the drive belt 550, and pushes a back cover 562 towards a front cover of the mail article 560.

Figure 6:
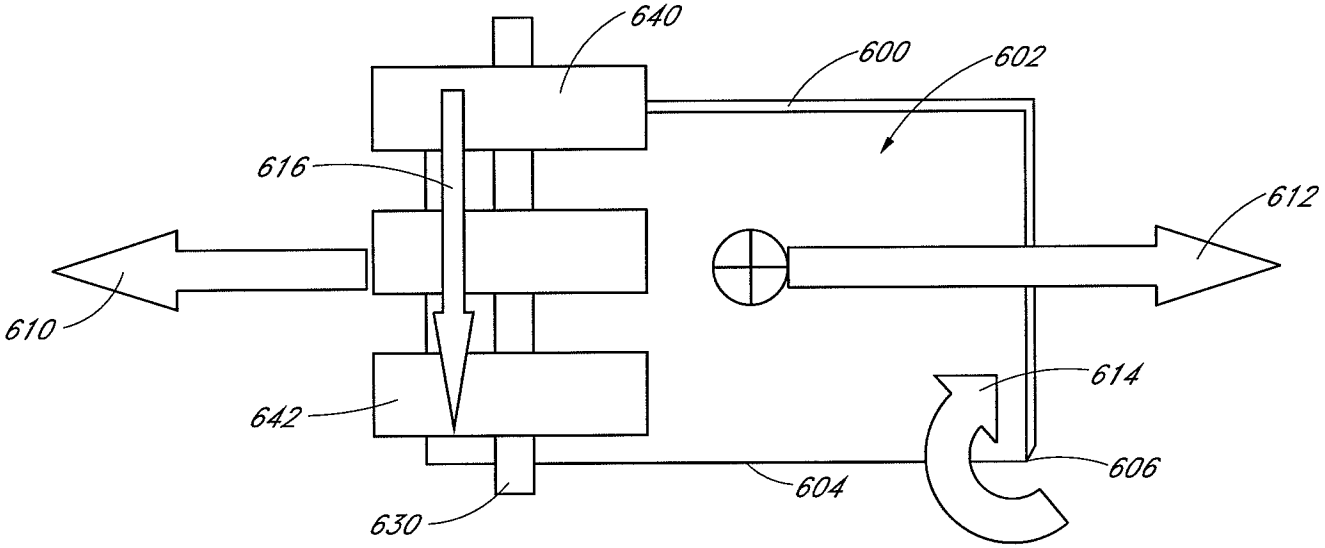
FIG. 6 is a schematic diagram illustrating the forces applied to an open article during singulation when one embodiment of an anti-rotation device is present.

FIG. 6 depicts at least some of the forces acting on an article 600 when an anti-rotation device having wheels 640 is present in a stack feeder. In various embodiments, each wheel 640 has a high friction outer surface 642, which resists any upward motion of a back cover 602 of the article 600 due to the force applied to the front cover (not shown), as described with reference to FIG. 3. Specifically, the lateral acceleration force 610 is applied to a front cover of the article 600 and inertial forces 612 act on the back cover 602 in the opposite direction. The interplay of these forces may result in the back cover 602 pivoting about an upstream corner 606 of a binding 604. To counter act this pivoting, the wheels 640 apply a counter-force to the back cover 602 of the article 600, which prevents twisting of the binding 604. By holding the front cover and back cover 602 of the mail article 600 together and providing a downward reaction force 616 on the back cover 602, the anti-rotation device distributes the torque 614 generated due to the lateral acceleration force 610 and the inertial force 612 over both the front and back covers and reduces the shearing stresses exerted on the binding 604 of the article 600.

Moreover, by pushing the back cover 602 toward the front cover using the wheels 640 and the resistance of the torsion bar, friction is created within the article 600 between the covers, and the friction acts to resist inertial shearing forces generated on either one of the covers. Thus, the anti-rotation device of various embodiments allows acceleration forces 610 to be applied to the article 600 without damaging the binding 604, the front cover or the back cover 602. Additionally, the wheels 640 rotate freely about the wheel shaft 630 via low-friction wheel bearings so that the presence of the wheels 640 does not add any new significant shearing forces to the article 600.

Figure 7:
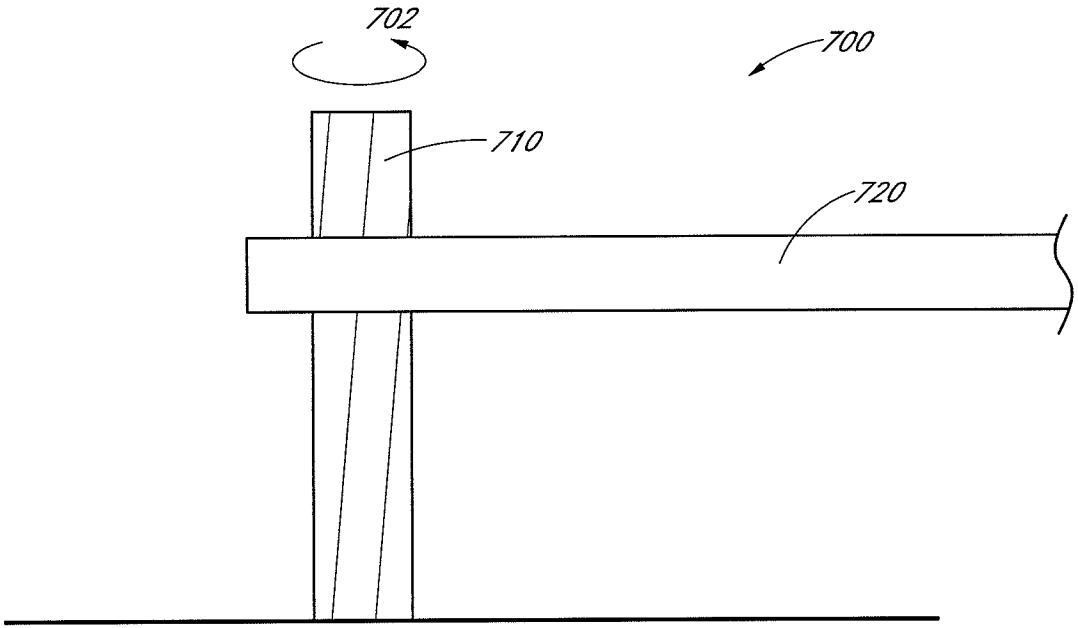
FIG. 7 is a side elevation view of one embodiment of a torsion rod found within an embodiment of an anti-rotation device.

FIG. 7 depicts a portion of an embodiment of an anti-rotation device 700. In FIG. 7, a torsion bar 710 and a portion of a lever arm 720 are in a second position. As shown, rotating the lever arm 720 from a first position to a second position through angle 702 causes the torsion bar 710 to twist. As described in detail above, the twisting generates a reaction torque in the torsion bar 710, motivating the torsion bar 710 and the coupled lever arm 720 back toward the first position. The torsion bar 710 can be formed of any suitable elastic material known to one skilled in the art. In some embodiments of an anti-rotation device, the torsion bar may be comprise, at least in part, by a helical torsion spring. In other embodiments, any other torsion element known to one skilled in the art may be used.

Figure 8B:
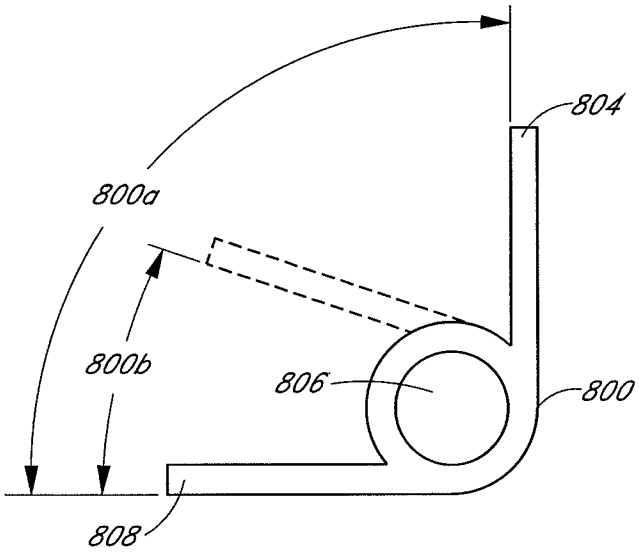
FIG. 8B is a top plan view of another embodiment of a torsion element.
Figure 8A:
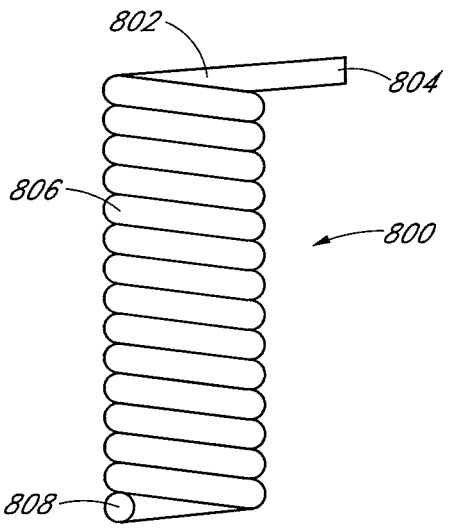
FIG. 8A is a side elevation view of one embodiment of a torsion element.

One embodiment of a torsion element, specifically, a helical torsion spring 800, is depicted in FIGS. 8A and 8B. As shown in FIG. 8A, the helical torsion spring 800 is formed of a coiled rod or wire 802 made of any suitable elastic material known to one skilled in the art, such as metal, steel, plastic, or other desired material. The torsion spring 800 includes a top end 804, a bottom end 808, and a plurality of coils 806. As shown in FIG. 8B, when a sideways force, also referred to as a bending moment or a torque, is applied to the top end 804, the top end 804 rotates inward, for example, from a first position 800*a* to a second position 800*b*, and the plurality of coils 806 coil tighter. The rotation generates a reaction torque in the torsion spring 800, motivating the torsion spring 800 and a coupled lever arm 820 (shown in FIG. 8C) back toward the first position 800*a*.

Figure 8C:
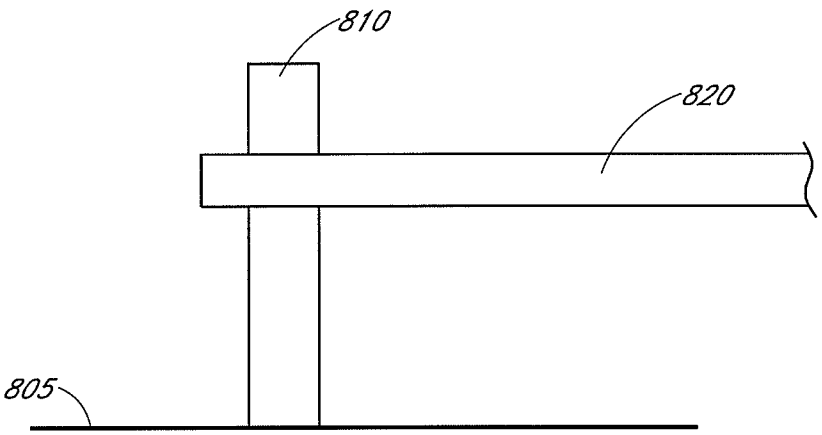
FIG. 8C is a side elevation view of one embodiment of a structural support member found within an embodiment of an anti-rotation device.

In anti-rotation device embodiments having a torsion spring 800, such as, for example, the anti-rotation device partially depicted in FIG. 8C, the torsion spring 800 is disposed within or around a structural support member 810. The structural support member 810 is immovable and connected to a base 805. In some embodiments, the torsion spring 800 is at least partially disposed within the structural support member 810, with a top end 804 protruding from the structural support member 810 and integrated into the lever arm 820. In some embodiments, the top end 804 may be embedded in the lever arm 820, or may be fastened by mechanical means such as a weld, a bracket, a screw, a rivet, or any other suitable fastening mechanism. The bottom end 808 of torsion spring 808 may be fixedly attached to the base or a non-moving torsion bar 810.

In operation, an article exerts a force felt on the lever arm, and the movement of the lever arm 820 results in movement of the top end 804 of the torsion spring 800. The bottom end 808 is fixedly attached, and thus, does not move. The movement of the top end 804 compresses the tension spring and stores potential mechanical energy within torsion spring 808, and resists the movement of the lever arm 820. In some embodiments, the torsion spring 800 is affixed to, and disposed around, the structural support member 810, within a bearing surrounding the structural support member 810. In such embodiments, a top end 804 of the torsion spring 800 is again integrated into, or coupled to, the lever arm 820 such that movement of the lever arm 820 from a first position 800*a* to a second position 800*b* causes the top end 804 of the torsion spring 800 to move accordingly. Such movement generates tension within the torsion spring 800 and causes the torsion spring 800 to apply a force to the lever arm 820 which resists rotational movement of the lever arm 820.

Figure 9:
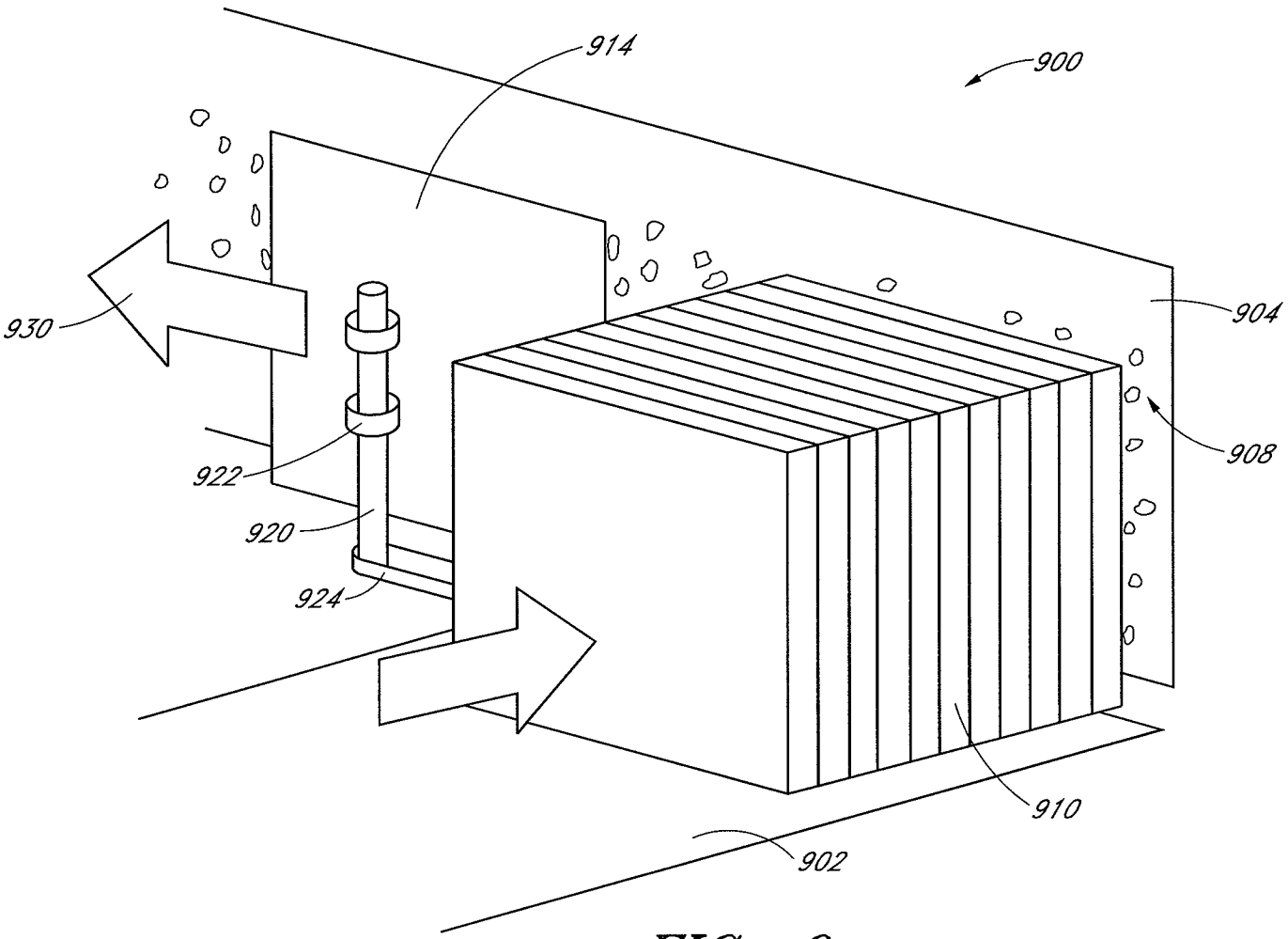
FIG. 9 is a schematic illustration of a bulk stack of mail being singulated when one embodiment of an anti-rotation device is present.

FIG. 9 depicts an embodiment of a stack feeder 900 for singulating a stack of articles which minimizes damage to each article by using an anti-rotation device 920. The stack feeder 900 comprises a horizontal conveyor belt 902 configured to move a stack of articles 910 forward, as described above. The stack feeder also comprises a drive belt assembly having a perforated drive belt 904 and a vacuum (not visible). The vacuum is configured to generate a suction force on the carrying surface 908 of the perforated drive belt 904. With such a configuration, the drive belt assembly is designed to pick up a leading article 914 in the stack of articles 910 using suction, couple the motion of the leading article 914 to the motion of the drive belt 904, and accelerate the leading article 914 laterally in the direction of a sorting component. In order to accelerate the mail article 914 without causing tearing or other damage to the article, an anti-rotation device 920 is positioned at or near the location of article acceleration. The anti-rotation device 920 includes some or all of the features described herein above.

Using such a stack feeder 900, a method of singulating a stack of articles 910 can be performed. In one embodiment, such a method includes moving a stack of articles 910 forward, separating and laterally accelerating the leading article 914 from the stack of articles 910, and applying friction to a back cover of the leading article 914 to resist upward motion of the leading article 914 during lateral acceleration. In various embodiments, friction is applied to the back cover by a plurality of wheels 922 coupled to a spring-loaded lever arm 924, which form part of an anti-rotation device 920. By including an anti-rotation device 900 into the method of singulation, acceleration forces 930 can be applied to the mail article 914 without damaging the mail.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A device for handling an item comprising:

a moveable lever arm comprising a biasing element and a rotatable member rotatable around a first axis, the rotatable member comprising a torsion bar; and a wheel attached to the rotatable member, wherein the wheel is configured to revolve around a second axis parallel to the first axis, and to contact a first surface of an item being moved by a lateral acceleration force applied by a drive belt in proximity to the movable lever arm, the item having first and second surfaces which are located adjacent and substantially parallel to each other and to the first and second axes;

wherein, as the item is moved by the drive belt, the first surface of the item contacts the drive belt, and the second surface of the item contacts an outer surface of the wheel; and wherein the rotatable member is configured to apply a counter-force to the second surface of the item via the wheel, so as to prevent displacement of the second surface with respect to the first surface.

2. The device of claim 1, wherein the biasing element resists movement of the rotatable member.

3. The device of claim 2, wherein the biasing element is a spring.

4. The device of claim 1 wherein the torsion bar flexes when the wheel is moved.

5. The device of claim 1 wherein the first and second surfaces of the item are rectangular and are attached to each other only along a single edge.

6. A device for reducing rotation of an article comprising:

a moveable lever arm comprising a torsion bar and a rotatable member rotatable about a first axis; and a revolving member coupled to the rotatable member and configured to revolve about a second axis parallel to the first axis; wherein:

when the rotatable member is in a first position, an outer surface of the revolving member is in contact with a surface parallel to first axis and the second axis, and when the rotatable member is in a second position, the torsion bar applies a first force to the revolving member via the rotatable member, and an outer surface of the revolving member is in contact with, and applies a second force to, an article which is also in contact with the surface.

7. The device of claim 6, wherein the rotatable member is configured to transition from the first position toward the second position when the article moves along the surface into contact with the revolving member.

8. The device of claim 6, wherein the second force applied by the revolving member to the article comprises a frictional force.

9. The device of claim 6, wherein the revolving member comprises a plurality of wheels rotatably disposed on a wheel shaft, the wheel shaft being coupled to the rotatable member.

10. The device of claim 6, further comprising a shaft positioned along the second axis, wherein the shaft is coupled to the rotatable member, and the revolving member is disposed about and configured to spin relative to the shaft.

11. The device of claim 6, wherein the revolving member comprises a shaft portion and an extended wheel portion fixed to the shaft portion, the shaft portion and the extended wheel portion configured to rotate about the second axis, and the shaft portion coupled to the rotatable member.

12. A system for singulating a stack of articles comprising:

a lateral drive device positioned to receive a stack of articles from a conveyor such that, as the stack of articles moves toward and contacts the lateral drive device, the lateral drive device laterally accelerates an article in the stack of articles; and an anti-rotation device comprising a torsion bar, the anti-rotation device disposed proximate the lateral drive device such that the anti-rotation device is capable of contacting the lateral drive device, and is configured to provide a frictional force to a back face of the article, to thereby resist upward motion of the back face during lateral acceleration of the article;

wherein, when the anti-rotation device is in a first configuration, the anti-rotation device is in contact with the lateral drive device, wherein, when the anti-rotation device is in a second configuration, the anti-rotation device is in contact with the back face of the article, and the front face of the article is in contact with the lateral drive device; and wherein the torsion bar is configured to resist motion of the anti-rotation device from the first configuration to the second configuration.

13. The system of claim 12, wherein the lateral drive device comprises a perforated drive belt.

14. The system of claim 13, wherein the perforated drive belt is in proximity to an air-moving component configured to apply a suction force to the front face of the article through the perforated drive belt to thereby couple lateral movement of the perforated drive belt with lateral movement of the article.

15. The system of claim 12, wherein the anti-rotation device comprises a rotatable member rotatable around a first axis parallel to the lateral drive device, and wherein the anti-rotation device moves between the first configuration and the second configuration by rotation of the rotatable member about the first axis.

16. The system of claim 15, wherein the anti-rotation device further comprises a contact surface attached to the rotatable member and rotatable about a second axis parallel to the first axis, the contact surface configured to contact the lateral drive device when the anti-rotation device is in the first configuration and to contact the back face of the article when the anti-rotation device is in the second configuration.

* * * * *